US006218919B1

(12) United States Patent
Ciarcia et al.

(10) Patent No.: US 6,218,919 B1
(45) Date of Patent: Apr. 17, 2001

(54) CIRCUIT BREAKER LATCH MECHANISM WITH DECREASED TRIP TIME

(75) Inventors: Ronald Ciarcia, Bristol; Lei Zhang Schlitz, Burlington; Gregory DiVincenzo; Macha Narender, both of Plainville, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/525,847

(22) Filed: Mar. 15, 2000

(51) Int. Cl.[7] ..... H01H 9/20
(52) U.S. Cl. ..... 335/167; 335/172
(58) Field of Search ..... 335/167–176, 335/23–25, 35–42

(56) References Cited

U.S. PATENT DOCUMENTS

| | | | |
|---|---|---|---|
| D. 367,265 | | 2/1996 | Yamagata et al. . |
| 2,340,682 | | 2/1944 | Powell . |
| 2,719,203 | | 9/1955 | Gelzheiser et al. . |
| 2,937,254 | | 5/1960 | Ericson . |
| 3,158,717 | | 11/1964 | Jencks et al. . |
| 3,162,739 | | 12/1964 | Klein et al. . |
| 3,197,582 | | 7/1965 | Norden . |
| 3,307,002 | | 2/1967 | Cooper . |
| 3,517,356 | | 6/1970 | Hanafusa . |
| 3,631,369 | | 12/1971 | Menocal . |
| 3,742,401 | * | 6/1973 | Strobel ..... 335/167 |
| 3,803,455 | | 4/1974 | Willard . |
| 3,883,781 | | 5/1975 | Cotton . |
| 4,129,762 | | 12/1978 | Bruchet . |
| 4,144,513 | | 3/1979 | Shafer et al. . |
| 4,158,119 | | 6/1979 | Krakik . |
| 4,165,453 | | 8/1979 | Hennemann . |
| 4,166,988 | | 9/1979 | Ciarcia et al. . |
| 4,220,934 | | 9/1980 | Wafer et al. . |
| 4,255,732 | | 3/1981 | Wafer et al. . |
| 4,259,651 | | 3/1981 | Yamat . |

(List continued on next page.)

FOREIGN PATENT DOCUMENTS

| | | |
|---|---|---|
| 819 008 | 12/1974 | (BE) . |
| 12 27 978 | 3/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |

(List continued on next page.)

*Primary Examiner*—Lincoln Donovan
*Assistant Examiner*—Taylor Nguyen
(74) *Attorney, Agent, or Firm*—Cantor Colburn LLP; Carl B. Horton

(57) ABSTRACT

A decreased mechanical trip time latching system for use in a molded case circuit breaker assembly. The latching system comprising a quick release primary latch having a first primary latching surface and a second primary latching surface. Where the second primary latching surface engages a first secondary latching surface located on an interactive secondary latch, to prevent the rotation of the quick release primary latch. The first primary latching surface engages a cradle latching surface, located on a cradle, to prevent the rotation of the cradle. Assembled to the interactive secondary latch is a trip bar. Activation of the trip bar rotates the secondary latch so that the first secondary latching surface moves out of contact with the second primary latching surface just prior to the interactive secondary latch making physical contact with the quick release primary latch. The quick release primary latch then rotates moving the first primary latching surface out of contact with the cradle latching surface thereby releasing the cradle. The cradle rotates and the operating system is activated to terminate current flow.

7 Claims, 3 Drawing Sheets

U.S. PATENT DOCUMENTS

| | | | | |
|---|---|---|---|---|
| 4,263,492 | | 4/1981 | Maier et al. . | |
| 4,276,527 | | 6/1981 | Gerbert-Gaillard et al. . | |
| 4,297,663 | | 10/1981 | Seymour et al. . | |
| 4,301,342 | | 11/1981 | Castonguay et al. . | |
| 4,360,852 | | 11/1982 | Gilmore . | |
| 4,368,444 | | 1/1983 | Preuss et al. . | |
| 4,375,021 | | 2/1983 | Pardini et al. . | |
| 4,375,022 | | 2/1983 | Daussin et al. . | |
| 4,376,270 | | 3/1983 | Staffen . | |
| 4,383,146 | | 5/1983 | Bur . | |
| 4,392,036 | | 7/1983 | Troebel et al. . | |
| 4,393,283 | | 7/1983 | Masuda . | |
| 4,401,872 | | 8/1983 | Boichot-Castagne et al. . | |
| 4,409,573 | | 10/1983 | DiMarco et al. . | |
| 4,435,690 | | 3/1984 | Link et al. . | |
| 4,467,297 | | 8/1984 | Boichot-Castagne et al. . | |
| 4,468,645 | | 8/1984 | Gerbert-Gaillard et al. . | |
| 4,470,027 | | 9/1984 | Link et al. . | |
| 4,479,143 | | 10/1984 | Watanabe et al. . | |
| 4,488,133 | | 12/1984 | McClellan et al. . | |
| 4,492,941 | | 1/1985 | Nagel . | |
| 4,541,032 | | 9/1985 | Schwab . | |
| 4,546,224 | | 10/1985 | Mostosi . | |
| 4,550,300 | | 10/1985 | Jencks et al. . | |
| 4,550,360 | | 10/1985 | Dougherty . | |
| 4,562,419 | | 12/1985 | Preuss et al. . | |
| 4,589,052 | | 5/1986 | Dougherty . | |
| 4,595,812 | | 6/1986 | Tamaru et al. . | |
| 4,611,187 | | 9/1986 | Banfi . | |
| 4,612,430 | | 9/1986 | Sloan et al. . | |
| 4,616,198 | | 10/1986 | Pardini . | |
| 4,622,444 | | 11/1986 | Kandatsu et al. . | |
| 4,622,530 | * | 11/1986 | Ciarcia et al. | 335/167 |
| 4,631,625 | | 12/1986 | Alexander et al. . | |
| 4,642,431 | | 2/1987 | Tedesco et al. . | |
| 4,644,438 | | 2/1987 | Puccinelli et al. . | |
| 4,649,247 | | 3/1987 | Preuss et al. . | |
| 4,658,322 | | 4/1987 | Rivera . | |
| 4,672,501 | | 6/1987 | Bilac et al. . | |
| 4,675,481 | | 6/1987 | Markowski et al. . | |
| 4,682,264 | | 7/1987 | Demeyer . | |
| 4,689,712 | | 8/1987 | Demeyer . | |
| 4,694,373 | | 9/1987 | Demeyer . | |
| 4,710,845 | | 12/1987 | Demeyer . | |
| 4,717,985 | | 1/1988 | Demeyer . | |
| 4,733,211 | | 3/1988 | Castonguay et al. . | |
| 4,733,321 | | 3/1988 | Lindeperg . | |
| 4,736,174 | * | 4/1988 | Castonguay et al. | 335/167 |
| 4,764,650 | | 8/1988 | Bur et al. . | |
| 4,768,007 | | 8/1988 | Mertz et al. . | |
| 4,780,786 | | 10/1988 | Weynachter et al. . | |
| 4,789,848 | * | 12/1988 | Castonguay et al. | 335/167 |
| 4,831,221 | | 5/1989 | Yu et al. . | |
| 4,870,531 | | 9/1989 | Danek . | |
| 4,883,931 | | 11/1989 | Batteux et al. . | |
| 4,884,047 | | 11/1989 | Baginski et al. . | |
| 4,884,164 | | 11/1989 | Dziura et al. . | |
| 4,900,882 | | 2/1990 | Bernard et al. . | |
| 4,910,485 | | 3/1990 | Bolongeat-Mobleu et al. . | |
| 4,914,541 | | 4/1990 | Tripodi et al. . | |
| 4,916,420 | | 4/1990 | Bartolo et al. . | |
| 4,916,421 | | 4/1990 | Pardini et al. . | |
| 4,926,282 | | 5/1990 | McGhie . | |
| 4,935,590 | | 6/1990 | Malkin et al. . | |
| 4,937,706 | | 6/1990 | Schueller et al. . | |
| 4,939,492 | | 7/1990 | Raso et al. . | |
| 4,943,691 | | 7/1990 | Mertz et al. . | |
| 4,943,888 | | 7/1990 | Jacob et al. . | |
| 4,950,855 | | 8/1990 | Bolonegeat-Mobleu et al. . | |
| 4,951,019 | | 8/1990 | Gula . | |
| 4,952,897 | | 8/1990 | Barnel et al. . | |
| 4,958,135 | | 9/1990 | Baginski et al. . | |
| 4,965,543 | | 10/1990 | Batteux . | |
| 4,983,788 | | 1/1991 | Pardini . | |
| 5,001,313 | | 3/1991 | Leclerq et al. . | |
| 5,004,878 | | 4/1991 | Seymour et al. . | |
| 5,029,301 | | 7/1991 | Nebon et al. . | |
| 5,030,804 | | 7/1991 | Abri . | |
| 5,057,655 | | 10/1991 | Kersusan et al. . | |
| 5,077,627 | | 12/1991 | Fraisse . | |
| 5,083,081 | | 1/1992 | Barrault et al. . | |
| 5,095,183 | | 3/1992 | Raphard et al. . | |
| 5,103,198 | | 4/1992 | Morel et al. . | |
| 5,115,371 | | 5/1992 | Tripodi . | |
| 5,120,921 | | 6/1992 | DiMarco et al. . | |
| 5,132,865 | | 7/1992 | Mertz et al. . | |
| 5,138,121 | | 8/1992 | Streich et al. . | |
| 5,140,115 | | 8/1992 | Morris . | |
| 5,153,802 | | 10/1992 | Mertz et al. . | |
| 5,155,315 | | 10/1992 | Malkin et al. . | |
| 5,166,483 | | 11/1992 | Kersusan et al. . | |
| 5,172,087 | | 12/1992 | Castonguay et al. . | |
| 5,178,504 | | 1/1993 | Falchi . | |
| 5,184,717 | | 2/1993 | Chou et al. . | |
| 5,187,339 | | 2/1993 | Lissandrin . | |
| 5,198,956 | | 3/1993 | Dvorak . | |
| 5,200,724 | | 4/1993 | Gula et al. . | |
| 5,210,385 | | 5/1993 | Morel et al. . | |
| 5,239,150 | | 8/1993 | Bolongeat-Mobleu et al. . | |
| 5,260,533 | | 11/1993 | Livesey et al. . | |
| 5,262,744 | | 11/1993 | Arnold et al. . | |
| 5,280,144 | | 1/1994 | Bolongeat-Mobleu et al. . | |
| 5,281,776 | | 1/1994 | Morel et al. . | |
| 5,296,660 | | 3/1994 | Morel et al. . | |
| 5,296,664 | | 3/1994 | Crookston et al. . | |
| 5,298,874 | | 3/1994 | Morel et al. . | |
| 5,300,907 | | 4/1994 | Nereau et al. . | |
| 5,310,971 | | 5/1994 | Vial et al. . | |
| 5,313,180 | | 5/1994 | Vial et al. . | |
| 5,317,471 | | 5/1994 | Izoard et al. . | |
| 5,331,500 | | 7/1994 | Corcoles et al. . | |
| 5,334,808 | | 8/1994 | Bur et al. . | |
| 5,341,191 | | 8/1994 | Crookston et al. . | |
| 5,347,096 | | 9/1994 | Bolongeat-Mobleu et al. . | |
| 5,347,097 | | 9/1994 | Bolongeat-Mobleu et al. . | |
| 5,350,892 | | 9/1994 | Rozier . | |
| 5,357,066 | | 10/1994 | Morel et al. . | |
| 5,357,068 | | 10/1994 | Rozier . | |
| 5,357,394 | | 10/1994 | Piney . | |
| 5,361,052 | | 11/1994 | Ferullo et al. . | |
| 5,373,130 | | 12/1994 | Barrault et al. . | |
| 5,379,013 | | 1/1995 | Coudert . | |
| 5,424,701 | | 6/1995 | Castonguary et al. . | |
| 5,438,176 | | 8/1995 | Bonnardel et al. . | |
| 5,440,088 | | 8/1995 | Coudert et al. . | |
| 5,449,871 | | 9/1995 | Batteux et al. . | |
| 5,450,048 | | 9/1995 | Leger et al. . | |
| 5,451,729 | | 9/1995 | Onderka et al. . | |
| 5,457,295 | | 10/1995 | Tanibe et al. . | |
| 5,467,069 | | 11/1995 | Payet-Burin et al. . | |
| 5,469,121 | | 11/1995 | Payet-Burin . | |
| 5,475,558 | | 12/1995 | Barjonnet et al. . | |
| 5,477,016 | | 12/1995 | Baginski et al. . | |
| 5,479,143 | | 12/1995 | Payet-Burin . | |
| 5,483,212 | | 1/1996 | Lankuttis et al. . | |
| 5,485,343 | | 1/1996 | Santos et al. . | |
| 5,493,083 | | 2/1996 | Olivier . | |
| 5,504,284 | | 4/1996 | Lazareth et al. . | |
| 5,504,290 | | 4/1996 | Baginski et al. . | |
| 5,510,761 | | 4/1996 | Boder et al. . | |
| 5,512,720 | | 4/1996 | Coudert et al. . | |

| | | |
|---|---|---|
| 5,515,018 | 5/1996 | DiMarco et al. . |
| 5,519,561 | 5/1996 | Mrenna et al. . |
| 5,534,674 | 7/1996 | Steffens . |
| 5,534,832 | 7/1996 | Duchemin et al. . |
| 5,534,835 | 7/1996 | McColloch et al. . |
| 5,534,840 | 7/1996 | Cuingnet . |
| 5,539,168 | 7/1996 | Linzenich . |
| 5,543,595 | 8/1996 | Mader et al. . |
| 5,552,755 | 9/1996 | Fello et al. . |
| 5,581,219 | 12/1996 | Nozawa et al. . |
| 5,604,656 | 2/1997 | Derrick et al. . |
| 5,608,367 | 3/1997 | Zoller et al. . |
| 5,784,233 | 7/1998 | Bastard et al. . |

FOREIGN PATENT DOCUMENTS

| | | |
|---|---|---|
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

CIRCUIT BREAKER LATCH MECHANISM WITH DECREASED TRIP TIME

BACKGROUND OF THE INVENTION

This invention relates to circuit breaker assemblies having an improved latching system that substantially decreases mechanical trip time. The improved latching system can be utilized, but not limited to circuit breaker assemblies rated for residential and lower current industrial applications and for high ampere-rated circuit breaker assemblies.

Conventional circuit breaker assemblies utilize a thermal-magnetic trip unit to automatically sense overcurrent circuit conditions and to subsequently interrupt circuit current accordingly. It is the practice of the circuit protection industry to mount a magnet portion of the magnetic trip unit around a bimetal trip unit and to arrange an armature as part of the circuit breaker latching system. It is well appreciated in the electric circuit protection field that the latching surfaces within the circuit breakers latching system must be carefully machined and lubricated in order to ensure repeated latching and unlatching between the surfaces over long periods of continuous use.

The special machining that is required includes a time consuming polishing process or a special machining or shaving operation on the latch systems latch surfaces. The smooth low friction surfaces are required to minimize the amount of tripping force that must be applied to overcome the bias of the operating spring and the static friction on the contracting latch surfaces. The trip force is the amount of force that must be applied to the trip bar to overcome the latch spring bias and latch surface friction In operation, a magnetic trip unit comprising an armature and a magnet is actuated upon the occurrence of an overcurrent condition. The actuation causes the armature, which is biased away from the magnet by a spring, to be rapidly driven towards the magnet so that a trip bar is activated. The thermal trip unit comprising a bimetal element senses overcurrent conditions by responding to the temperature rise on the bimetal element. When an overcurrent condition occurs over a period of time, the bimetal flexes and activates the trip bar.

Once activated, the trip bar sets in motion the activation and disengagement of a latching system comprising a primary latch, secondary latch, and a cradle. The trip bar, secured to the secondary latch, drives the secondary latch clockwise about a fixed point so that the secondary latch is moved out of contact with the primary latch. The primary latch in turn is positioned to prevent the rotation of the cradle. When the primary latch is released from the secondary latch, the cradle acts on the primary latch urging it to rotate clockwise about a fixed point. Once the primary latch is moved out of contact with the cradle, the cradle is released allowing it to rotate counterclockwise about a fixed point. As the cradle pivots the upper and lower links collapse under the biasing of an operating spring to draw a moveable contact arm containing a moveable contact to the open position. In the open position the moveable contact and a fixed contact are separated thereby terminating the circuit.

The primary latch and the secondary latch have a plurality of latching surfaces. The latching surfaces are defined as the surface of the latch that makes physical contact with any adjoining surface. The first latching surface of the secondary latch is positioned against the second latching surface of the primary latch. A first latching surface of the primary latch is positioned against the latching surface of the cradle. As previously described when the trip bar is actuated, it drives the secondary latch so that the secondary latch rotates about its pivot causing the first latching surface of the secondary latch to break contact with the second latching surface of the primary latch. Once this occurs, the first latching surface of the primary latch has a force bearing on it by the cradle at the cradle latching surface. If this force is great enough to overcome any resistant forces existing between the latching surfaces, the primary latch will rotate about its pivot point so that the first latching surface of the primary latch breaks contact with the latching surface of the cradle. Once released, the cradle rotates counterclockwise and set in motion a chain of events that trips the breaker.

Conventionally both the cradle and the primary latch are fabricated from a stamping operation followed by a shaving operation to flatten and smooth the latching surface of the cradle and the latching surfaces on the primary latch to maintain a low trip force between the cradle and the primary latch. To aid in the release of the latches there is a primary latching force provided by the operating spring. During use there is often a degradation of the latching surfaces due to wear and contaminates on the various latching surfaces. Even when the latching surfaces are prepared in an effort to minimize friction and the various springs provide a biasing force it is unpredictable if and when the latching system will be fully activated. If significant contaminates or excessive wear exists on the various latching surfaces, the latching system will not activate and result in a stalled situation between the cradle and the primary latch. In particular, once the primary latch is released by the secondary latch, the cradle through the latching surface of the cradle and supplied by provides a force on the primary latch at the first latching surface. This force must be great enough to overcome the friction forces acting between the first latching surface of the primary latch and the latching surface of the cradle. If contaminants or other sources cause the friction between these latching surfaces to become too large the first latching surface of the primary latch will not rotate and release the cradle so that the system is in a stalled situation.

Conventional circuit breakers have a size limitation imposed upon them in order to fit into panel boards of residential, office and light industrial applications. While the outer dimensions of the circuit breaker are fixed, short circuit current magnitudes available from electrical utilities have increased, requiring circuit breaker designers to seek new and improved operating and trip mechanisms which limit the energy let-through. To do this, one must minimize the current and/or the time from the onset of overload to arc extinction. One way to accomplish this is to provide an extremely fast acting circuit breaker capable of early contact separation upon detection of an overload.

SUMMARY OF THE PRESENT INVENTION

It is therefore desirable to provide a molded case circuit breaker capable of exceedingly fast tripping action effective in limiting to acceptable levels let-through energy incident with a high fault current interruption. This is accomplished by utilizing an improved latching system employed to immediately release the primary latch once the secondary latch is disengaged by the actuation of the trip bar. Once the primary latch is set free it subsequently releases the cradle so that the breaker mechanism is tripped by the movement of the link system comprising an upper link, a lower link and the operating spring thereby allowing the moveable contact and the fixed contact to separate thereby terminating the circuit. This immediate release of the primary latch, upon the secondary latch disengagement, achieves contact separation in significantly shorter time than when reliance for the release of the cradle is solely dependent upon the cradle forces and minimal friction between the cradle surface and the primary latch surface.

The improved latching system comprises the primary latch, the secondary latch and the trip bar. The improved latching system is designed to function so that upon activation of the trip bar and the disengagement of the secondary latch, the primary latch, being in direct physical contact with the trip bar/secondary latch configuration is immediately released. The primary latch and the secondary latch are shaped and positioned so that once the trip bar is activated, an extension on the secondary latch acts directly on an extension on the primary latch. Therefore the secondary latch drives the primary latch clockwise about its pivot point to positively release the cradle. The timing is such that as soon as the secondary latch clears the primary latch the primary latch is also freed. The timing of the release of the cradle is immediately after the release of the primary latch from the secondary latch.

Because the trip bar/secondary latch configuration is in direct physical contact with the primary latch the mechanical trip time is decreased thereby limiting the energy let-through to an acceptable value. Additionally, the release of the cradle is no longer only dependent on the cradle forces and the finishing of the latching surfaces to reduce friction to effectuate tripping of the breaker.

BRIEF DESCRIPTION OF THE DRAWINGS

Referring now to the drawings wherein like elements are numbered alike in the several Figures.

DETAILED DESCRIPTION OF THE INVENTION

Figure 1:
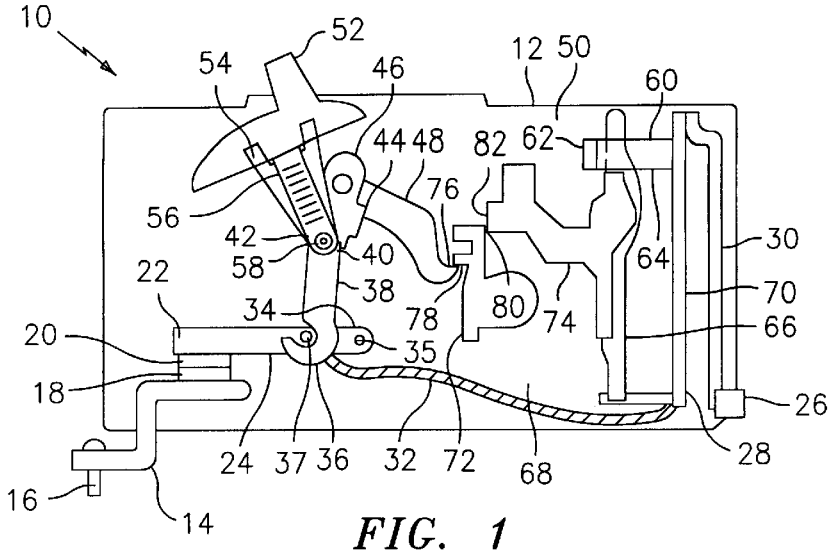
FIG. 1 (PRIOR ART)
FIG. 1 is a side view of a single contact arm molded case circuit breaker shown with the contacts closed according to the prior art.

FIG. 1 shows a conventional circuit breaker assembly of the prior art, which is generally indicated at 10. It is to be appreciated that this invention deals with one, two, three, or four-pole circuit breakers formed with one or multiple adjacent compartments for housing multiple pole units, a common operating mechanism is provided to simultaneously actuate the interrupter of each pole. For ease of illustration the Figures will show only one pole. FIG. 1 shows a circuit breaker used for lower circuit interruption applications. Although not shown, the invention can also be used in many different types of circuit breaker assemblies. When activated, the invention operates in the same manner regardless of which circuit breaker assembly in which it is mounted. Therefore, when describing the prior art, FIG. 1 will be referenced however it is to be appreciated that the improved latching system 92 can be utilized in any type circuit breaker assembly.

The circuit breaker assembly 10 includes an insulative housing 12 shown with one side of the circuit breaker removed. At one end of the housing 12 exists a line strap 14 and a line terminal screw 16. Permanently affixed to the line strap 14 is a fixed contact 18. When the circuit breaker assembly 10 is in an on mode the fixed contact 18 makes electrical contact with a moveable contact 20 which is permanently affixed to a first end 22 of a moveable operating arm 24. At the opposite end of the housing 12 exists a load lug 26 that connects with a bimetal 28 by means of a load strap 30. A braided conductor 32 electrically connects the bimetal 28 to the moveable operating arm 24.

The moveable operating arm 24 is pivotally connected at a second end 34 intermediate to a pivot 35 and pivotally connected by a pivot 37 at a distance from the second end 34 to a first end 36 of a lower link 38. A second end 40 of the lower link 38 is pivotally connected to a first end 42 of an upper link 44, which in turn is pivotally connected at a second end 46 to a cradle 48. The cradle 48 is used to mechanically interact with a latching system 68 and a trip unit assembly 50 with the moveable operating arm 24. An on-off handle 52 operatively connects with the moveable operating arm 24 by means of a handle yoke 54, a mechanism spring 56 and the upper and lower links 44, 38. The handle yoke 54 connects the mechanism spring 56 with the upper and lower links 44, 38 through an operating springs support pin 58.

Useful in detecting short circuit conditions is a magnetic trip unit 60 comprising an armature 62 and a magnet 64. When the circuit breaker assembly 10 is subjected to short circuit conditions, a magnetic attraction is immediately generated between the armature 62 and the magnet 64. Subsequently, the armature 62 is drawn in the direction of the magnet 64 which strikes a trip bar 66 thereby setting into motion the activation of a latching system 68. Additionally, useful in detecting overcurrent conditions is a thermal trip unit 70 that reacts to temperature rise on the bimetal element 28 causing the bimetal 28 to flex and strike the trip bar 66 which in turn activates the latching system 68.

The latching system 68 comprises a primary latch 72, a secondary latch 74 and the trip bar 66. When the circuit breaker assembly 10 is in the "ON" mode, the fixed and moveable contacts 18, 20 are closed so that electrical continuity is retained throughout the assembly 10 allowing the current to flow.

Figure 2:
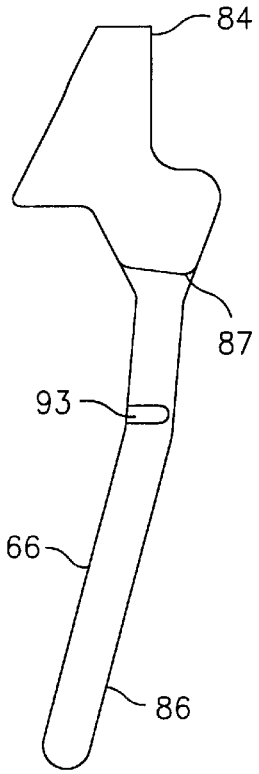
FIG. 2 is a side view of a trip bar according to the prior art.
Figure 3:
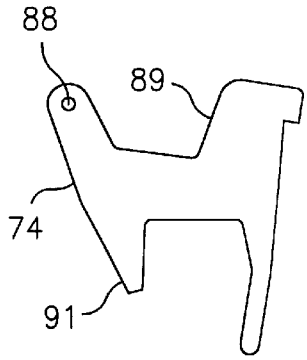
FIG. 3 is a side view of the secondary latch according to the prior art.
Figure 4:
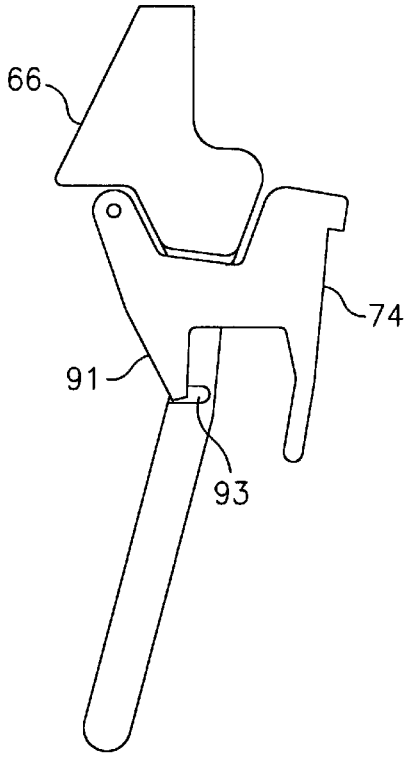
FIG. 4 is a side view of the trip bar assembled to the secondary latch according to the prior art.

A cradle latching surface 76 exists at the end of the cradle 48 located opposite the cradle 48 connection with the upper link 44. When the circuit breaker assembly 10 is in the "ON" mode the latching system 68 is set. Setting the latching system 68 includes positioning the cradle latch surface 76 under a first primary latching surface 78 so that the first primary latching surface 78 prevents the cradle 48 from rotating counterclockwise about its pivot point. A second primary latching surface 80 is positioned against a first secondary latching surface 82 so that the secondary latch 74 is in the path of the primary latch 72 preventing the primary latch 72 from rotating clockwise about its pivot point. Referring to FIGS. 2–4, FIG. 2 showing the trip bar 66, FIG. 3 showing the secondary latch 74 and FIG. 4 showing the trip bar 66 assembled in the secondary latch 74. The trip bar 66 comprises a projection 84, a leg 86 and a crosspiece 87 wherein the trip bar crosspiece 87 fits in a slot 89 on the secondary latch 74. A secondary latch pivot pin 88 allows the trip bar projection 84 and the trip bar leg 86 to rotate clockwise upon contact with the bimetal 28 or the armature 62. The secondary latch further comprises a leg 91 which snappingly engages a lip 93 on the trip bar 66 so that when activated, the two rotate together.

In operation, when the magnetic trip unit 60 is subjected to tripping conditions. A magnetic attraction is immediately generated between the armature 62 and the magnet 64 drawing the armature 62 in the direction of the magnet 64 thereby striking the projection 84 of the trip bar 66. When dealing with lower level overload conditions, the bimetal 28 flexes and strikes the leg 86 of the trip bar 66. Once the projection 84 or leg 86 of the trip bar 66 is contacted the trip bar 66 rotates clockwise. When this occurs the secondary latch 74 is also rotated clockwise so that the secondary latching surface 82 is moved from the path of the primary latch 72. Acting under tension from the mechanical spring 56 biasing the cradle 48 to rotate in a counterclockwise direction about its pivot point, the biasing force pulls at the cradle 48 so that the cradle latching surface 76 pushes up on the first primary latching surface 78. When the force exerted by the cradle 48 acting on the primary latch 72 overcomes the friction force between the two latching surfaces, it drives the primary latch 72 in a clockwise direction thereby freeing the cradle latching surface 76. Once the cradle latching surface 76 is freed, the cradle 48 rotates counterclockwise thereby collapsing the upper link 44 and the lower link 38 so that the moveable operating arm 24 can move to the open position. This separates the moveable contact 20 and the fixed contact 18 so that the current flow is terminated.

Figure 5:
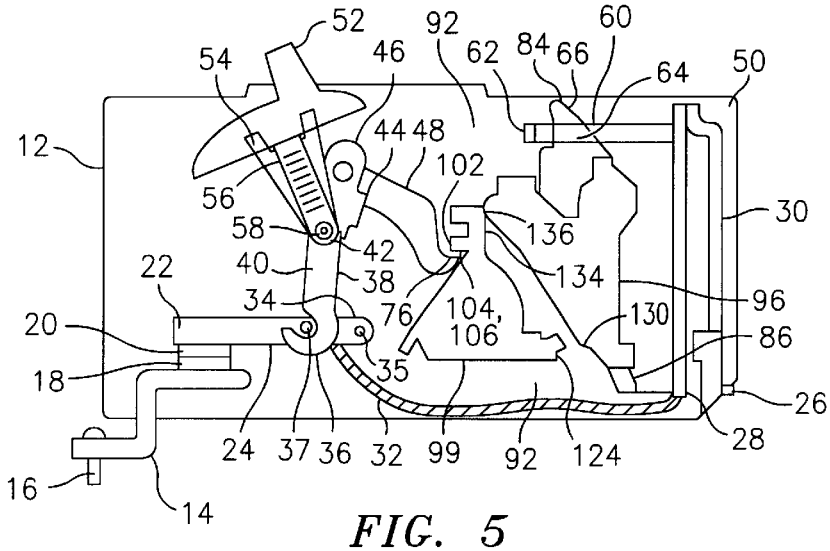
FIG. 5 is a side view of a single contact arm molded case circuit breaker with an improved latching system according to the present invention.
Figure 6:
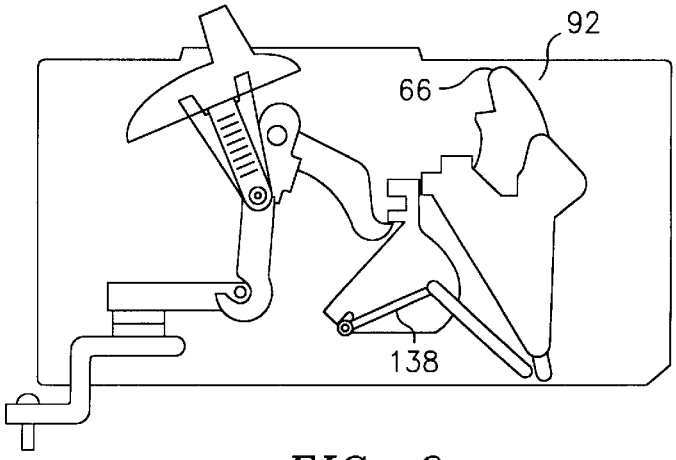
FIG. 6 is a side view of a second embodiment of a single contact arm molded case circuit breaker with an improved latching system according to the present invention.

In order to improve the circuit breaker assembly mechanical trip time and eliminate a potential latch and cradle stall condition an improved latching system 92 in accordance with an exemplary embodiment of the present invention will be described in detail. Referring to FIGS. 5 and 6, FIG. 5 showing the exemplary embodiment of the present invention and FIG. 6 showing a second embodiment of the present invention, when like components are used reference numbers remain the same. Conventional trip systems as described above depend on the cradle forces alone to apply the appropriate forces required to rotate the primary latch 72 thereby releasing the cradle latching surface 76 from contact with the first primary latching surface 78. In these conventional systems, the mechanical trip time is slow and results in excess energy let-through. The improved latching system 92 depicted in FIGS. 5 and 6 limits energy let-through to acceptable levels by decreasing the mechanical trip time.

Figure 7:
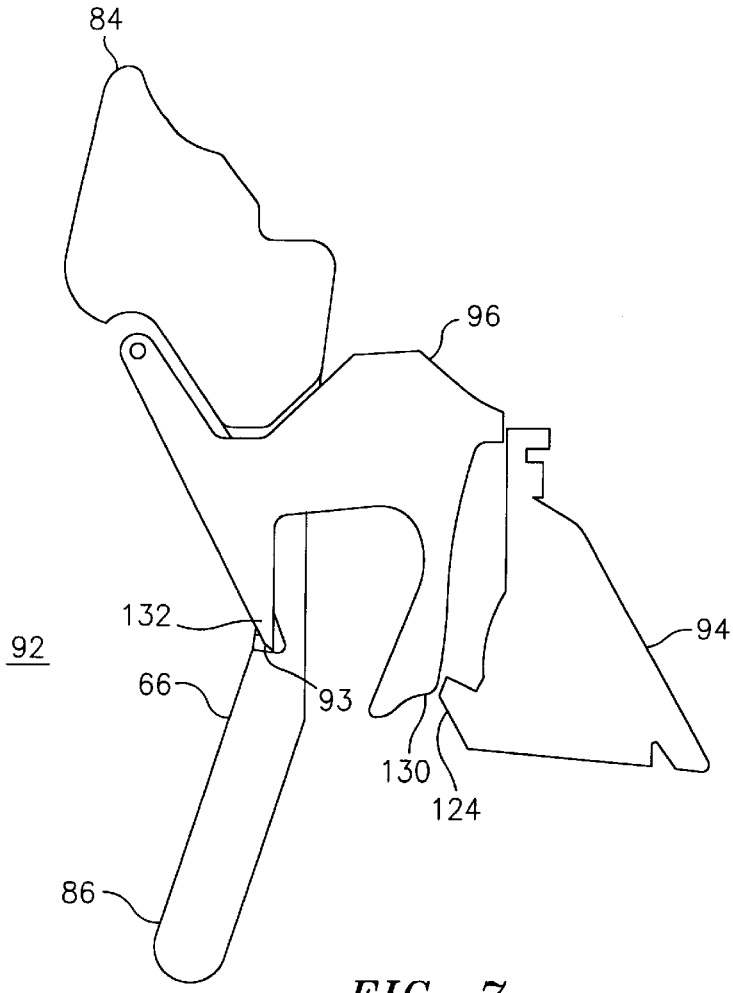
FIG. 7 is a side view of the improved latching system according to the present invention.
Figure 8:
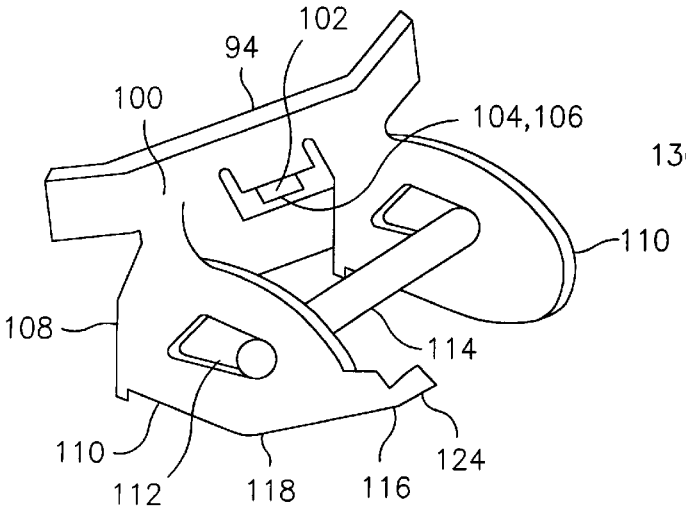
FIG. 8 is a perspective view of a self actuating primary latch according to the present invention.
Figure 9:
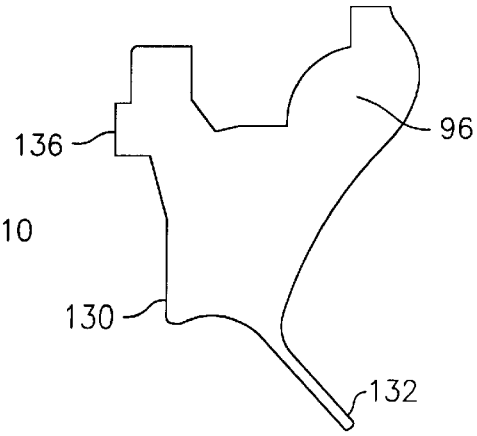
FIG. 9 is a side view of a secondary latch according to the present invention.

As shown in FIG. 7, the improved latching system 92 comprises a quick release primary latch 94, an interactive secondary latch 96 and the trip bar 66. Although the interactive secondary latch 96 and the trip bar 66 are described as two separate elements, the secondary latch 96 and the trip bar 66, could have their features combined into one interactive secondary latch/trip bar element 140. FIG. 8 details the quick release primary latch 94 and FIG. 9 shows the interactive secondary latch 96. The quick release primary latch 94 comprising a top cross bar 100 having a primary latch extension 102 extending generally perpendicular to the top cross bar 100 at approximately the midpoint of the top cross bar 100. The primary latch extension 102 being of sufficient length so that a bottom surface 104 of the extension 102 becomes a first primary latching surface 106 capable of interfacing with the cradle latch surface 76 to prevent the cradle 48 from counterclockwise rotation.

Referring to FIG. 8, extending at an angle from the top cross bar 100 in the same direction as the primary latch extension 102 on either side of the primary latch extension 102 are two primary legs 108. Extending generally perpendicular to the two primary legs 108 away from the primary latch extension 102 are two primary arms 110. The two primary arms 110 each having a generally oblong opening 112 through which a primary latch pivot pin 114 passes. At a distal end 116 of at least one of the primary arms 110, a cam element 124 extends. The formation of the cam element 124 as shown in FIG. 8 is illustrative and is not meant to be limiting.

The trip bar 66, as shown in FIG. 7, comprises the trip bar projection 84 and the trip bar leg 86. When the trip bar 66 is assembled to the interactive secondary latch 96, the trip bar 66 can freely rotate. Shown in FIG. 9, the interactive secondary latch 96 further comprises a step 130 and a leg 132. Wherein the leg 132 securely snaps into the lip 93 on the trip bar 66 such that when the trip bar 66 is activated by movement of the armature 62 or the bimetal 28, the interactive secondary latch 96 pivots clockwise with the trip bar 66. The step 130 is designed to make physical contact with the cam element 124 upon the release of the interactive secondary latch 96.

As shown in FIG. 5, the improved latching system 92 is set in the manner previously described, a second primary latching surface 134 is positioned against a first secondary latching surface 136 so that the quick release primary latch 94 is prevented from rotating clockwise about its pivot point. When the trip bar 66 is activated, it drives the interactive secondary latch 96 clockwise so that the second primary latching surface 134 and the first secondary latching surface 136 are moved out of contact with each other thereby releasing the quick release primary latch 94. At this point in a conventional system, the activated latching system 68 would depend on the cradle forces to drive the primary latch 72 clockwise so that the first primary latching surface 78 moves thereby releasing the cradle latching surface 76.

In the improved latching system 92, instantaneously upon the interactive secondary latch 96 clearing the quick release primary latch 94, the step 130 makes physical contact with the cam element 124. This results in the immediate rotation of the quick release primary latch 94 thereby moving the first primary latching surface 106 out of contact with the cradle latching surface 76. Once the cradle latching surface 76 is freed, the cradle 48 rotates counterclockwise thereby collapsing the upper link 44 and the lower link 38 so that the moveable operating arm 24 can move to the open position. This separates the moveable contact 20 and the fixed contact 18 so that the current flow is terminated.

The cam element 124, located on the quick release primary latch 94, and the step 130, located on the interactive secondary latch 96, are designed so that the moment the first secondary latching surface 136 clears the second primary latching surface 134, the step 130 makes physical contact with the, cam element 124.

As shown in FIG. 6 a second embodiment of the present invention relies on a linkage mechanism 138 positioned between and physically connecting the trip bar 66 and the quick release primary latch 94. The linkage mechanism 138 is utilized to drive the quick release primary latch 94 clockwise about its pivot point as the trip bar 66 is activated. This insures positive tripping and the elimination of any possibility of a stalled situation.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A latching system for use in a molded case circuit breaker assembly comprising;

a quick release primary latch having a first primary latching surface and a second primary latching surface;

a cradle having a cradle latching surface which engages the first primary latching surface preventing the rotation of the cradle; and an interactive secondary latch/trip bar having a first secondary latching surface which engages the second primary latching surface preventing the rotation of the quick release primary latch and wherein activation of the interactive secondary latch/trip bar causes it to rotate so that the first secondary latching surface moves out of contact with the second primary latching surface prior to the interactive secondary latch/trip bar making contact with the quick release primary latch rotating the quick release primary latch thereby moving the first primary latching surface out of contact with the cradle latching surface releasing the cradle.

2. The latching system according to claim 1, wherein the interactive secondary latch/trip bar comprises;

an interactive secondary latch having a first secondary latching surface which engages the second primary latching surface preventing the rotation of the quick release primary latch; and a trip bar that is assembled to the interactive secondary latch, wherein activation of the trip bar rotates the secondary latch so that the first secondary latching surface moves out of contact with the second primary latching surface prior to the interactive secondary latch making contact with the quick release primary latch rotating the quick release primary latch thereby moving the first primary latching surface out of contact with the cradle latching surface releasing the cradle.

3. The latching system according to claim 2, wherein the interactive secondary latch further comprises a leg that securely snaps into a lip formed on the trip bar so that when the trip bar is assembled to the interactive secondary latch the two rotate together.

4. The latching system according to claim 3, wherein the interactive secondary latch further comprises a step that extends in the same direction as the first secondary latching surface.

5. The latching system according to claim 4, wherein the quick release primary latch further comprises at least one cam element that extends in a direction opposite the first primary latching surface.

6. The latching system according to claim 5, wherein the interactive secondary latch rotates in a clockwise direction so that the first secondary latching surface moves out of contact with the second primary latching surface, the continued rotation of the interactive secondary latch drives the step to make physical contact with the cam element forcing the quick release primary latch to rotate clockwise releasing the first primary latching surface from the cradle latching surface.

7. A latching system for use in a molded case circuit breaker assembly comprising;

a quick release primary latch having a first primary latching surface and a second primary latching surface;

an interactive secondary latch having a first secondary latching surface which engages the second primary latching surface preventing the rotation of the quick release primary latch;

a cradle having a cradle latching surface which engages the first primary latching surface preventing the rotation of the cradle;

a trip bar assembled to the interactive secondary latch; and a linkage mechanism attaching the trip bar and the quick release primary latch, wherein activation of the trip bar rotates the secondary latch so that the first secondary latching surface moves out of contact with the second primary latching surface as the linkage mechanism drives the quick release primary latch thereby moving the first primary latching surface out of contact with the cradle latching surface releasing the cradle.

* * * * *